US005228244A

United States Patent [19]

Chu

[11] Patent Number: 5,228,244

[45] Date of Patent: Jul. 20, 1993

[54] PNEUMATIC TOOL HAVING SYNERGETIC DUST-REMOVAL DRAFTING EFFECT

[76] Inventor: George Chu, c/o Hung Hsing Patent Service Center, P.O. Box 55-1670, Taipei (10477), Taiwan

[21] Appl. No.: 913,216

[22] Filed: Jul. 15, 1992

[51] Int. Cl.[5] ..... B24B 55/06

[52] U.S. Cl. ..... 51/273; 51/170 R; 51/169

[58] Field of Search ..... 51/273, 169, 170 R, 51/170 T, 170 PT, 170 MT, 134.5 F; 409/137, 254; 408/67; 144/252 R

[56] References Cited

U.S. PATENT DOCUMENTS

| | | | |
|---|---|---|---|
| 3,824,745 | 7/1974 | Hutchins | 51/273 |
| 4,051,880 | 10/1977 | Hestily | 51/273 |
| 4,302,910 | 12/1981 | Tschacher | 51/273 |

*Primary Examiner*—Roscoe V. Parker

[57] ABSTRACT

A pneumatic tool includes: a grip portion, a tool body having a rotor rotatably mounted in a rotor chamber of the tool body as driven by a compressed air source flowing through an inlet passage in the grip portion, a tool unit secured to a lower end of a shaft of the rotor encased within a hood secured to the tool body, a Venturi tube portion formed in a side portion of the tool body for directing an exhaust air stream from the rotor chamber to a throat of the Venturi tube portion for drafting and removing dust in the hood as produced when operating the tool unit, and a turbo-exhauster secured to an upper end of the shaft of the rotor for sucking a dust-containing exhaust air stream from the Venturi tube portion to an outlet passage in the grip portion for synergetically drafting the exhaust air stream for efficiently removing the dust and also for balanceably operating the pneumatic tool.

5 Claims, 5 Drawing Sheets

PNEUMATIC TOOL HAVING SYNERGETIC DUST-REMOVAL DRAFTING EFFECT

BACKGROUND OF THE INVENTION

A conventional pneumatic tool such as a sander as shown in FIG. 1 includes a sander tool T rotatably secured with a shaft of a rotor R driven by an incoming compressed air source through an air inlet passage I formed in a grip G, and an exhaust pipe E connecting to a hood encasing the sander tool T with a hose H connected to a collection bag C for the collection of dust which is produced from the area performing a rotational sanding operation by the tool T, and a Venturi tube V formed in the exhaust pipe E adjacent to a by-pass branch B for directing a by-pass inlet compressed air stream from the branch B for drafting a dust-laden exhaust air stream through the pipe E and hose H for dust removal providing a clean working environment.

However, such a conventional rotary pneumatic tool has the following drawbacks:

1. Since a by-pass incoming compressed air stream is directed through the branch B for effecting the vacuum drafting in the exhaust pipe E, the main air flow rate for driving the rotor R of the air motor will be reduced to decrease the output power of the sander T, thereby reducing the motor efficiency and its productivity.

2. An additional exhaust pipe E should be provided to connect the hood of the sander tool T to a dust-collection hose H to thereby increase an installation cost and also increase operational inconvenience for handling such a cumbersome assembly.

3. The operating (sanding) end, i.e., the sander tool T, is rotatably mounted on a lower end of the rotor shaft remotely positioned from the rotor end which may therefore cause unbalancing or torsional vibration when running the air motor. The unbalanced or vibrational operation of the conventional pneumatic tool may waste mechanical energy of the pneumatic system and may easily cause operator fatigue or even negatively influence his (her) occupational health.

Although a balancer may be further provided for overcoming such a vibrational shortcoming of the air tool, an additional installation of the balancer may increase equipment volume and weight of the tool, still influencing its handling and operation as well as its esthetic appearance.

SUMMARY OF THE INVENTION

The object of the present invention is to provide a pneumatic tool made as a compact unit for efficiently directing a compressed air stream both for smoothly driving a rotary air tool and for effectively drafting and removing dust from the processing area by the rotary tool.

Another object of the present invention is to provide a pneumatic tool including: a grip portion, a tool body having a rotor rotatably mounted in a rotor chamber of the tool body as driven by a compressed air source flowing through an inlet passage in the grip portion, a tool unit secured to a lower end of a shaft of the rotor encased within a hood secured to the tool body, a Venturi tube portion formed in a side portion of the tool body for directing an exhaust air stream from the rotor chamber to a throat of the Venturi tube portion for drafting and removing dust in the hood as produced by the tool unit, and a turbo-exhauster secured to an upper end of the shaft of the rotor for sucking a dust-containing exhaust air stream from the Venturi tube portion to an outlet passage in the grip portion synergetically drafting the exhaust air stream for efficient removal of the dust laden exhaust air stream and also balanceably operating the pneumatic tool.

DETAILED DESCRIPTION

Figure 1:
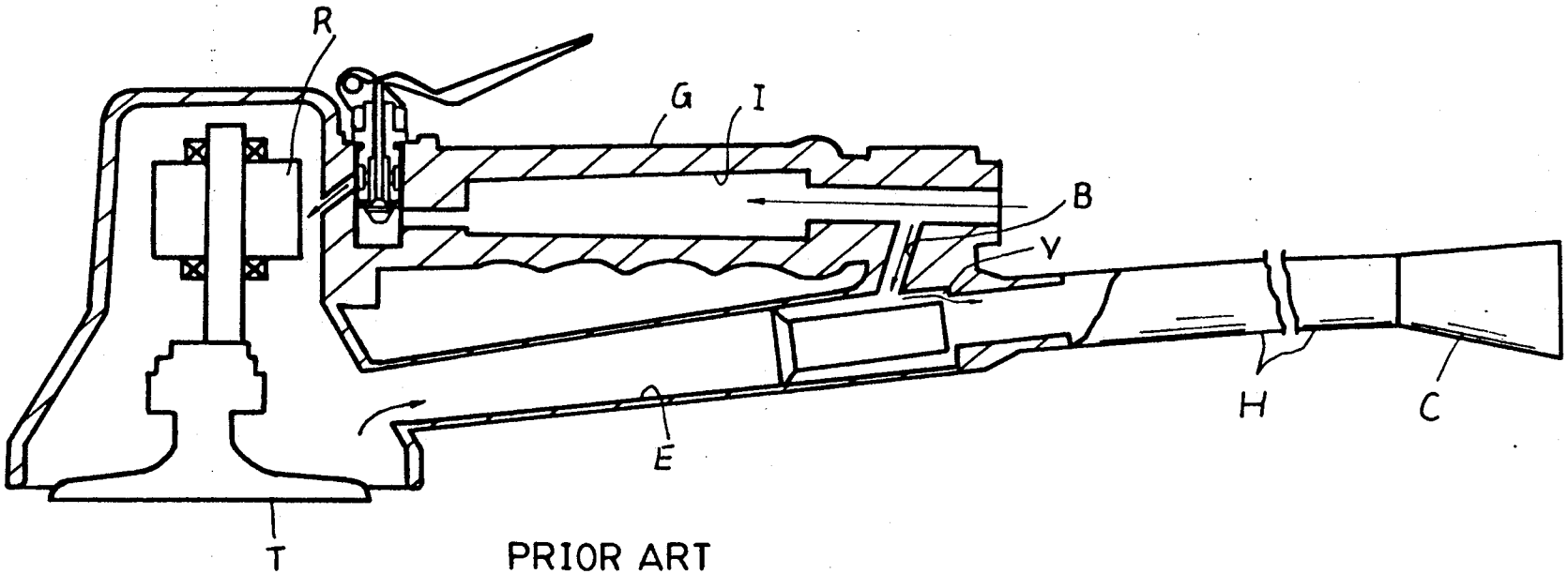
PRIOR ART FIG.1
FIG. 1 shows a prior art of a conventional pneumatic tool.
Figure 2:
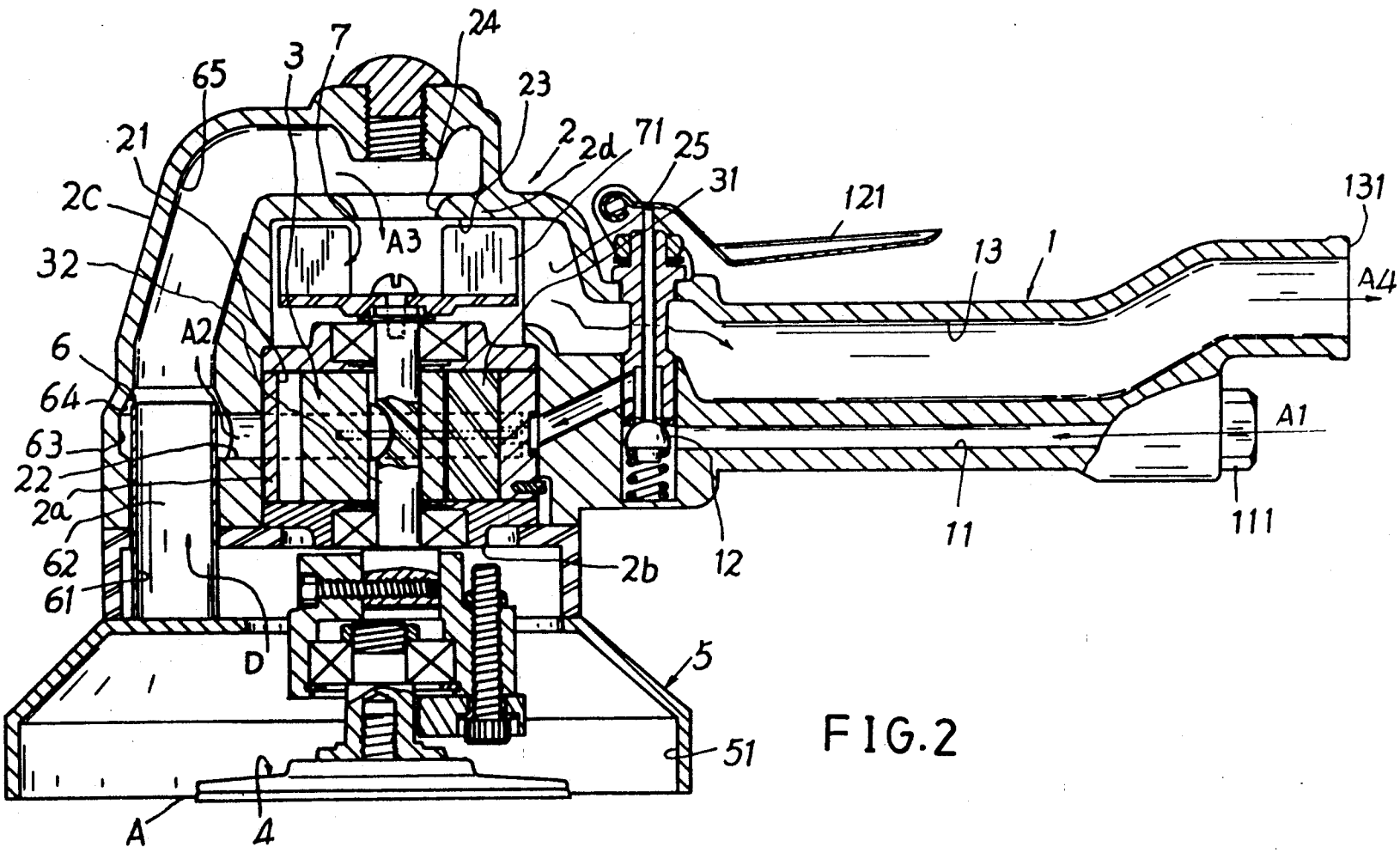
FIG. 2 is a sectional drawing of the present invention.
Figure 3:
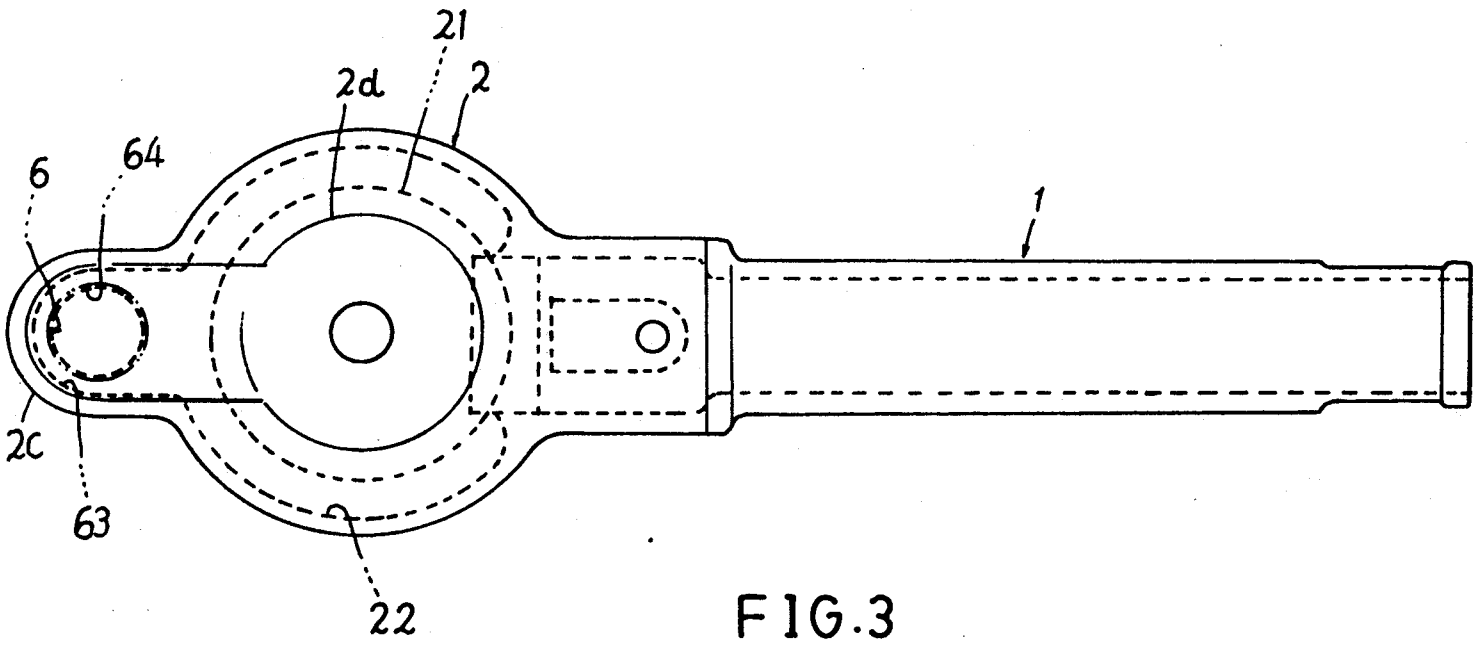
FIG. 3 is a top-view illustration of the present invention.
Figure 4:
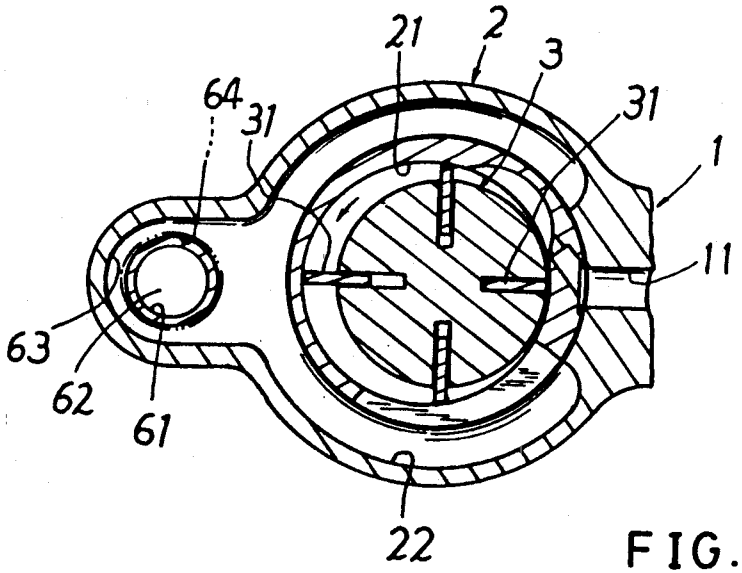
FIG. 4 is a partial sectional drawing showing a tool body of the present invention.

As shown in FIGS. 2–4, the present invention comprises: a grip portion 1, a tool body 2, a rotor means 3, a tool means 4, a hood 5, a Venturi tube portion 6, and a turboexhauster 7.

The grip portion 1 includes: an inlet air passage 11 longitudinally formed through the grip portion 1 for directing an incoming compressed air stream A1 through an inlet adapter 111 connector with an air hose or tube (not shown) of a compressed air source, a valve 12 having a valve handle 121 pivotally mounted on the grip portion 1 for opening or closing the air stream from the inlet passage 11, and an outlet air passage 13 longitudinally formed through the grip portion 11 juxtapositional to the inlet air passage 11 for discharging the exhaust air stream outwardly and having an outlet adapter 131 formed on an outer end portion of the grip portion 1 for connecting an outlet hose which may be accompanied with a dust collection bag (not shown).

The tool body 2 includes: a rotor chamber 21 formed in a central portion **2*a* of the tool body 2 connecting the inlet air passage 11 of the grip portion 1 and having a rotor means 3 rotatably mounted in the rotor chamber 21, an air exhausting passage 22 disposed around the rotor chamber 21 for guiding an exhaust air stream discharged from the rotor chamber 21 sidewardly towards the Venturi tube portion 6 (air flow of A2), a propeller chamber 23 formed in an upper portion 2*d* of the valve body 2 for rotatably holding the turbo-exhauster 7 in the propeller chamber 23, a central suction port 24 formed in a central portion of the propeller chamber 23 fluidically connecting the Venturi tube portion 6, and a discharge port 25 formed in a side portion of the propeller chamber 23 communicating the outlet air passage 13 in the grip portion 1**.

The rotor means 3 may include a plurality of sliding vanes 31 radially held in slots in the rotor means 3 to be pneumatically driven by the incoming compressed air stream for rotating the rotor means 3 having a rotor shaft 32 secured with the rotor means 3. Other types 3 of rotor means 3, other than the rotary vane type, may be modified by those technically skilled and are not limited in this invention.

Figure 5:
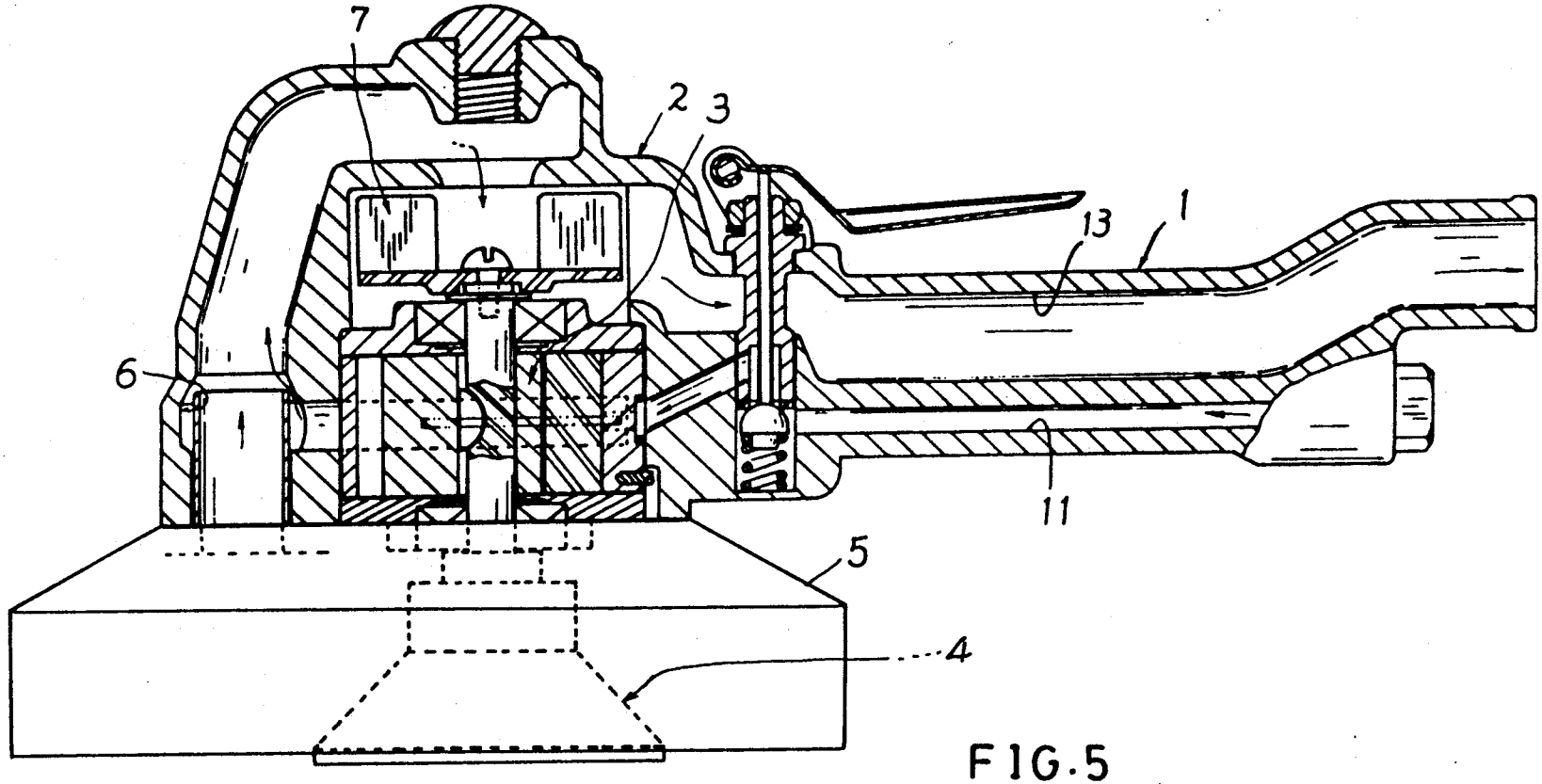
FIG. 5 shows another preferred embodiment of the present invention.

The tool means 4 is secured on a lower end portion of the rotor shaft 32 and encased within the hood 5 secured on a lower portion **2*b* of the tool body 2. The tool means 4 may be selected from: a grinder, a sander, a drill, a taper, a reamer, a buffer or even an air cleaner, which are not limited in this invention. As shown in FIG. 2, the tool means 4** may be a sander, while the tool means 4 as shown in FIG. 5 may be replaced with a cleaner provided with a rotary brush within a large hood 5.

The Venturi tube portion 6 includes: a sleeve member 61 defining a central sleeve hole 62 therein and inserted in a side portion 2c of the tool body 2 with the sleeve hole 62 fluidically connecting a dust-collection chamber 51 confined within the hood 5 disposed around the tool means 4, a cylindrical bore portion 63 formed in the side portion 2c of the tool body 2 and annularly surrounding the sleeve member 61 and connecting the air exhausting passage 22 adjacent to the rotor chamber 21 of the tool body 2 and defining a throat portion 64 between the cylindrical bore portion 63 and the sleeve member 61, the throat portion 64 tapered upwardly from the cylindrical bore portion 63 to connect a suction channel 65 diverging upwardly from the throat portion 64 and protruding upwardly in the side portion 2c of the tool body 2 to be connected with the central suction port 24 of the tool body 2, whereby upon effecting a driving flow of an exhaust air stream A2 (FIG. 2) through the throat portion 64, a dust-laden air stream D will be drafted upwardly through the sleeve hole 62 and the dust-collection chamber 51 in the hood 5 for removing the dust from the processing area A under the hood 5 when operating the tool means 4.

The turboexhauster or exhausting propeller means 7 includes a plurality of propeller blades 71 radially secured on an upper end of the rotor shaft 32 of the rotor means 3, whereby upon a driving of the rotor means to rotate the propeller blades 71, the exhaust air stream having dust laden thereon from the suction channel 65 will be sucked inwardly through the central suction port 24 (air flow A3) in the central portion of the propeller chamber 23 and will then be forcedly discharged through the discharge port 25 of the tool body 2 and the outlet air passage 13 in the grip portion 11 for dust removal and collection (air flow A4).

The present invention has the following advantages superior to a conventional dust removing pneumatic tool:

1. The vacuuming or forced drafting operation is continuously effected at two zones, i.e., the Venturi tube portion 6 and the turbo-exhauster 7 downstream from the air stream discharged from the rotor chamber 21 of the tool body 2, so that the exhaust air stream is drafted *synergetically* for effective dust removal and also for smoothly guiding the air flow at an optimum rate for maintaining a high operating efficiency of the pneumatic tool.

2. The propeller blades 71 are mounted on the upper end of the rotor shaft 32 of which the lower shaft end is secured with the tool 4 to thereby symmetrically balance the rotation of the rotor means 3, minimizing any torsional vibration in order to prevent energy waste and operator fatigue.

3. The air (inlet and outlet) flow path is arranged fluidically so that the complete tool set can be made as a compact unit with smaller volume and lighter weight for its convenient handling, operation, and also for enhancing its esthetic appearance.

A modification of the invention can be made by parallelly directing a waste air stream having dust laden thereon through a channel in the tool body from the working area A as directly drafted by the turboexhauster 7, and an exhaust air stream from an outlet port in the rotor chamber 21 after driving the rotor means 3, i.e., both the waste air stream laden with dust and the exhaust air stream from rotor means, into an exhaust pipe through a common outlet air passage or dual outlet air passages (not shown) formed in the grip portion 1.

I claim:

1. A pneumatic tool comprising: a grip portion, a tool body having a rotor means rotatably mounted in a rotor chamber of the tool body as driven by a compressed air stream flowing through an inlet passage in the grip portion, a tool means secured to a lower end of a rotor shaft of the rotor means encased within a hood secured to a lower portion of the tool body, a Venturi tube portion formed in a side portion of the tool body which is effected by directing an exhaust air stream from the rotor chamber of said tool body to a throat portion of the Venturi tube portion for drafting a dust-laden air stream from the hood when operating the tool means, and a turbo-exhauster secured to an upper end of the rotor shaft of the rotor means for sucking a dust-containing exhaust air stream from the Venturi tube portion to be discharged into an outlet passage in the grip portion for synergetically drafting the exhaust air stream for effectively removing the dust laden in the exhaust air stream and for balanceably operating the pneumatic tool.

2. A pneumatic tool according to claim 1, wherein said tool body includes: said rotor chamber formed in a central portion of the tool body communicating the inlet air passage of the grip portion and having said rotor means rotatably mounted in the rotor chamber, an air exhausting passage disposed around the rotor chamber for guiding an exhaust air stream discharged from the rotor chamber sidewardly towards the Venturi tube portion, a propeller chamber formed in an upper portion of the valve body for rotatably holding the turboexhauster in the propeller chamber, a central suction port formed in a central portion of the propeller chamber fluidically communicating the Venturi tube portion, and a discharge port formed in a side portion of the propeller chamber communicating the outlet air passage in the grip portion.

3. A pneumatic tool according to claim 2, wherein said Venturi tube portion includes: a sleeve member defining a central sleeve hole therein and inserted in a side portion of the tool body with the sleeve hole fluidically connecting to a dust-collection chamber confined within the hood disposed around the tool means, a cylindrical bore portion formed in a side portion of said tool body and annularly surrounding the sleeve member for connecting the air exhausting passage adjacent to the rotor chamber of the tool body and defining a throat portion between the cylindrical bore portion and the sleeve member, the throat portion tapered upwardly from the cylindrical bore portion to connect a suction channel which diverges upwardly from the throat portion and protrudes upwardly in the side portion of the tool body to be communicated with the central suction port of the propeller chamber of the tool body having said turboexhauster formed in the propeller chamber, whereby upon effecting a driving flow of an exhaust air stream through the throat portion, a dust-laden air stream will be drafted upwardly from the dust-collection chamber in the hood through the sleeve hole for removing the dust produced from the processing area acted by the tool means.

4. A pneumatic tool according to claim 3, wherein said turboexhauster includes a plurality of propeller blades radially secured on an upper end of the rotor shaft of the rotor means, the propeller blades operatively rotated as driven by said rotor means to suck an exhaust air stream having dust laden therein from the suction channel of the Venturi tube portion through the central suction port in the central portion of the propeller chamber and to discharge the exhaust air stream through the discharge port of the tool body and the outlet air passage in the grip portion for dust removal.

5. A pneumatic tool comprising: a grip portion, a tool body having a rotor means rotatably mounted in a rotor chamber of the tool body as driven by a compressed air stream flowing through an inlet passage in the grip portion, a tool means secured to a lower end of a rotor shaft of the rotor means encased within a hood secured to a lower portion of the tool body, said rotor chamber having an outlet port for discharging an exhaust air stream from the rotor chamber into an outlet passage in the grip portion, and a turbo-exhauster secured to an upper end of the rotor shaft of the rotor means for sucking a dust-containing air stream through a channel in the tool body from a working area acted by the tool means within the hood to be discharged into the outlet passage for removing the dust laden in the air stream and for balanceably operating the pneumatic tool.

* * * * *